US006237391B1

(12) United States Patent
Beckett

(10) Patent No.: US 6,237,391 B1
(45) Date of Patent: May 29, 2001

(54) AUTOMOBILE BODY REPAIR KIT

(76) Inventor: Ernest Beckett, One Charles Pl., Pennsville, NJ (US) 08070

( * ) Notice: Subject to any disclaimer, the term of this patent is extended or adjusted under 35 U.S.C. 154(b) by 0 days.

(21) Appl. No.: 09/566,150

(22) Filed: May 5, 2000

(51) Int. Cl.[7] ..... B21C 3/16
(52) U.S. Cl. ..... 72/476; 72/479; 72/705
(58) Field of Search ..... 72/705, 457, 476, 72/479

(56) References Cited

U.S. PATENT DOCUMENTS

| | | | | |
|---|---|---|---|---|
| 2,941,429 | | 6/1960 | Mason | 31/15 |
| 3,570,289 | | 3/1971 | Smyers | 72/479 |
| 3,797,295 | * | 3/1974 | Sanchez | 72/705 |
| 5,461,900 | | 10/1995 | Gutierrez | 72/479 |
| 6,006,580 | * | 12/1999 | Frawley | 72/705 |

OTHER PUBLICATIONS

S & G Tool Catalog, S & G Tool Aid Corp., T–81R, Jun. 1982.*

* cited by examiner

*Primary Examiner*—Ed Tolan
(74) *Attorney, Agent, or Firm*—Goldstein & Canino

(57) ABSTRACT

An automobile body repair kit including a first tool adapted for shaping quarter panel, trunk lid lines, and fender lines of the body of the automobile. A second tool is adapted for straightening top edges of a frame of the body of the automobile. A third tool is adapted for removing kinks from inside frame rails of the body of the automobile. A fourth tool is adapted for straightening frame rails of the body of the automobile.

1 Claim, 2 Drawing Sheets

AUTOMOBILE BODY REPAIR KIT

BACKGROUND OF THE INVENTION

The present invention relates to an automobile body repair kit and more particularly pertains to repairing dents and damage to a body of an automobile.

The use of vehicle body working tools is known in the prior art. More specifically, vehicle body working tools heretofore devised and utilized for the purpose of repairing a vehicle's body are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,461,900 to Gutierrez discloses an elongated tubular chisel-like impact vehicle repair tool with interchangeable heads for different types of bending and straightening. U.S. Pat. No. 3,570,289 to Smyers discloses a vehicle body repair tool comprised of an elongated portion, attachable to the body, capable of receiving a weighted impact to depress or pull a body section into shape. U.S. Pat. No. 2,941,429 to Mason discloses an impact type tool for removing dents from metal parts such as automobile bodies.

While these devices fulfill their respective, particular objective and requirements, the aforementioned patents do not describe an automobile body repair kit for repairing dents and damage to a body of an automobile.

In this respect, the automobile body repair kit according to the present invention substantially departs from the conventional concepts and designs of the prior art, and in doing so provides an apparatus primarily developed for the purpose of repairing dents and damage to a body of an automobile.

Therefore, it can be appreciated that there exists a continuing need for a new and improved automobile body repair kit which can be used for repairing dents and damage to a body of an automobile. In this regard, the present invention substantially fulfills this need.

SUMMARY OF THE INVENTION

In the view of the foregoing disadvantages inherent in the known types of vehicle body working tools now present in the prior art, the present invention provides an improved automobile body repair kit. As such, the general purpose of the present invention, which will be described subsequently in greater detail, is to provide a new and improved automobile body repair kit which has all the advantages of the prior art and none of the disadvantages.

To attain this, the present invention essentially comprises a first tool adapted for shaping quarter panel, trunk lid lines, and fender lines of the body of the automobile. The first tool is comprised of a vertically oriented rod having an upper end and a lower end. The upper end has an enlarged cylinder disposed thereon. The lower end has an elongated horizontally oriented narrow plate secured thereto. A second tool is adapted for straightening top edges of a frame of the body of the automobile. The second tool is comprised of an elongated pole having an upper end and a lower end. The upper end is bifurcated. A third tool is adapted for removing kinks from inside frame rails of the body of the automobile. The third tool is comprised of an elongated rod having an upper end and a lower end. The upper end has a knob secured thereto. The lower end has an enlarged flat plate secured thereto. A fourth tool is adapted for straightening frame rails of the body of the automobile. The fourth tool is comprised of an elongated rod having an upper end and a lower end. The lower end has a knob secured thereto. The upper end is tapered.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved automobile body repair kit which has all the advantages of the prior art vehicle body working tools and none of the disadvantages.

It is another object of the present invention to provide a new and improved automobile body repair kit which may be easily and efficiently manufactured and marketed.

It is a further object of the present invention to provide a new and improved automobile body repair kit which is of durable and reliable construction.

An even further object of the present invention is to provide a new and improved automobile body repair kit which is susceptible of a low cost of manufacture with regard to both materials and labor, and which accordingly is then susceptible of low prices of sale to the consuming public, thereby making such an automobile body repair kit economically available to the buying public.

Even still another object of the present invention is to provide a new and improved automobile body repair kit for repairing dents and damage to a body of an automobile.

Lastly, it is an object of the present invention to provide a new and improved automobile body repair kit including a first tool adapted for shaping quarter panel, trunk lid lines, and fender lines of the body of the automobile. A second tool is adapted for straightening top edges of a frame of the body of the automobile. A third tool is adapted for removing kinks from inside frame rails of the body of the automobile. A fourth tool is adapted for straightening frame rails of the body of the automobile.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
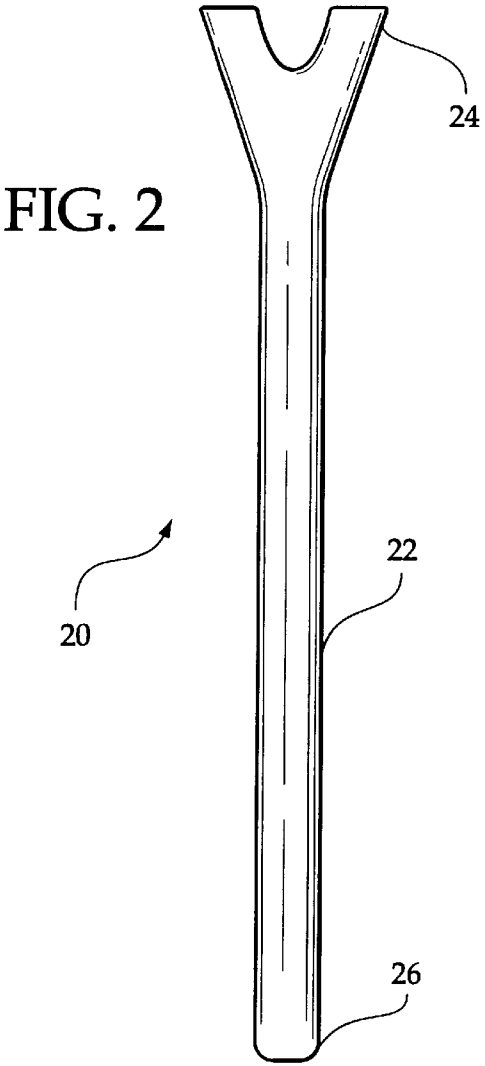
FIG. 2 is a front view of a second tool of the present invention.
Figure 1:
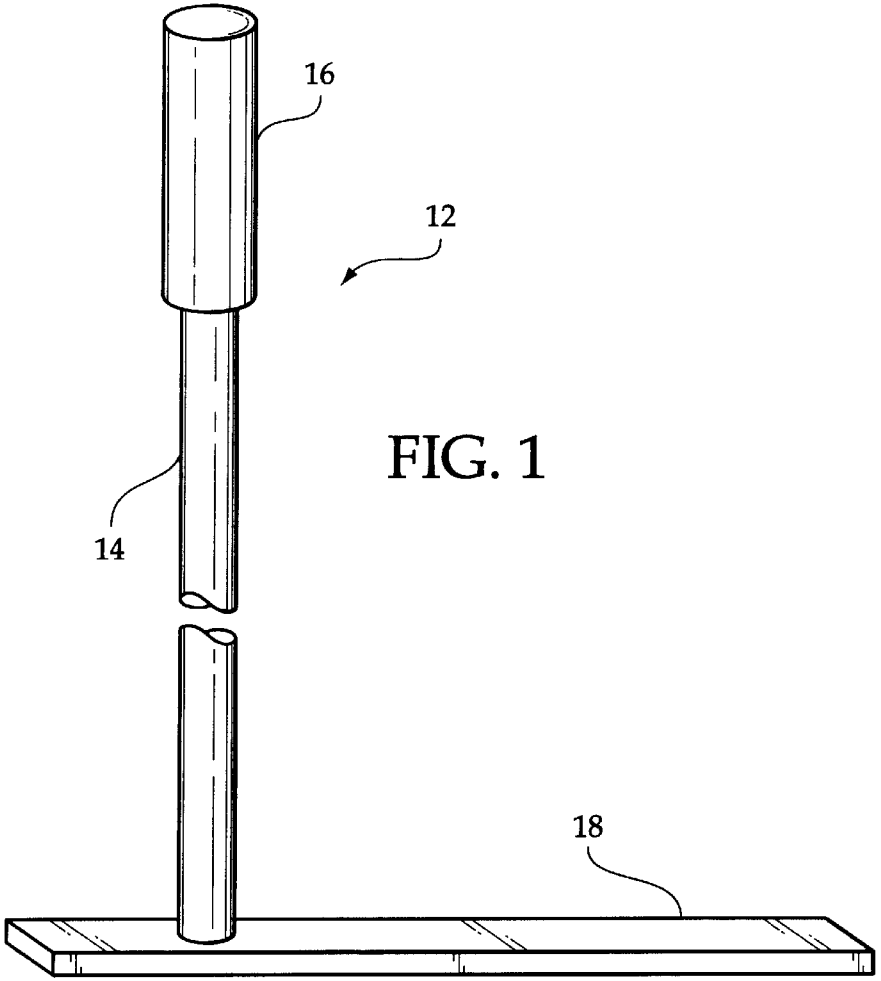
FIG. 1 is a front view of a first tool of the automobile body repair kit constructed in accordance with the principles of the present invention.
Figure 4:
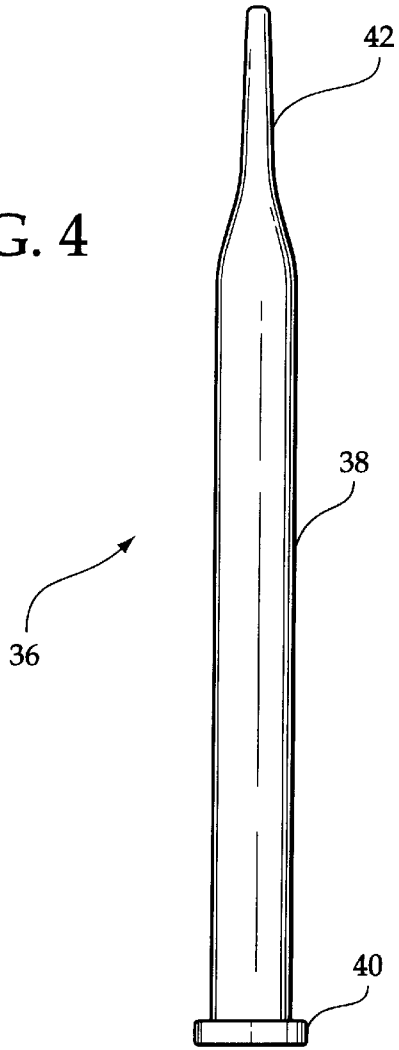
FIG. 4 is a front view of a fourth tool of the present invention.
Figure 3:
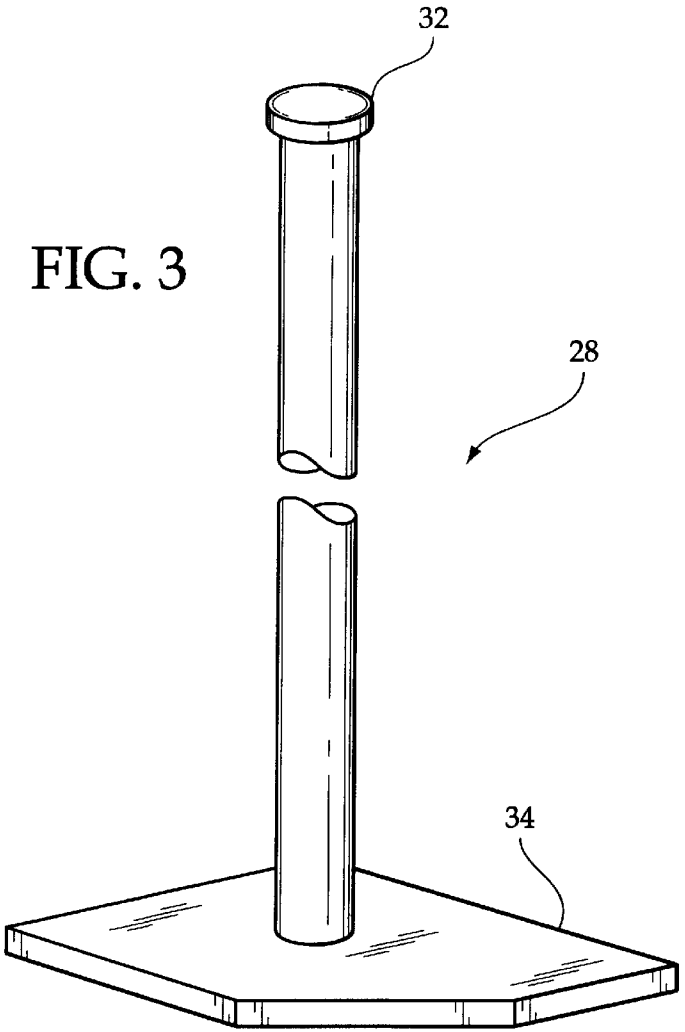
FIG. 3 is a front view of a third tool of the present invention.

With reference now to the drawings, and in particular, to FIGS. 1 through 4 thereof, the preferred embodiment of the new and improved automobile body repair kit embodying the principles and concepts of the present invention and generally designated by the reference number 10 will be described.

Specifically, it will be noted in the various Figures that the device relates to an automobile body repair kit for repairing dents and damage to a body of an automobile. In its broadest context, the device consists of a first tool, a second tool, a third tool, and a fourth tool. Such components are individually configured and correlated with respect to each other so as to attain the desired objective.

The first tool 12 is adapted for shaping quarter panel, trunk lid lines, and fender lines of the body of the automobile. Note FIG. 1. The first tool 12 is comprised of a vertically oriented rod 14 having an upper end and a lower end. The upper end has an enlarged cylinder 16 disposed thereon. The lower end has an elongated horizontally oriented narrow plate 18 secured thereto. The first tool 12 will assist a repairman in getting the quarter panel, trunk lid lines back to shape on unitized cars. It will also help repair fender lines that meet the hood. The narrow plate 18 would be positioned on the quarter panel, fender, rocker, or door edge to roll edge back to the lines. The cylinder 16 would be hit with a four to five pound hammer as the narrow plate 18 slides up and down the inside edges.

The second tool 20 is adapted for straightening top edges of a frame of the body of the automobile. Note FIG. 2. The second tool 20 is comprised of an elongated pole 22 having an upper end 24 and a lower end 26. The upper end 24 is bifurcated. The second tool 20 is important to straighten the top edges of a frame to extend down along the sides of the engine. The bifurcated upper end 24 would be placed on the edge of the frame. The lower end 26 would be hit with an eight to ten pound hammer. It could also be used for the inside of a box frame to heat and push out kinks on the inside of the frame rail.

The third tool 28 is adapted for removing kinks from inside frame rails of the body of the automobile. Note FIG. 3. The third tool 28 is comprised of an elongated rod 30 having an upper end and a lower end. The upper end has a knob 32 secured thereto. The lower end has an enlarged flat plate 34 secured thereto. The third tool 28 would be used to hit the frame rails using the eight to ten pound hammer to remove kinks on the inside frame rails. It could also be used for various corners and angles in the frame rails to straighten the kinks. The third tool 28 can be hit from both the upper and lower ends.

The fourth tool 36 is adapted for straightening frame rails of the body of the automobile. Note FIG. 4. The fourth tool 36 is comprised of an elongated rod 38 having an upper end and a lower end. The lower end has a knob 40 secured thereto. The upper end is tapered 42. The fourth tool 36 straightens kinks and high spots in frame rails of cars and trucks. The fourth tool 36 is used in conjunction with a frame machine. The fourth tool 36 is placed on the kinks of the rail being straightened and hit with a hammer until the kinked areas are flush with the rails.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An automobile body repair kit for repairing dents and damage to a body of an automobile comprising, in combination:

a first tool for shaping quarter panel, trunk lid lines, and fender lines of the body of the automobile, the first tool being comprised of a vertically oriented rod having an upper end and a lower end, the upper end having an enlarged cylinder disposed thereon, the lower end having an elongated horizontally oriented narrow plate secured thereto;

a second tool for straightening top edges of a frame of the body of the automobile, the second tool being comprised of an elongated pole having an upper end and a lower end, the upper end being bifurcated;

a third tool for removing kinks from inside frame rails of the body of the automobile, the third tool being comprised of an elongated rod having an upper end and a lower end, the upper end having a knob secured thereto, the lower end having an enlarged flat plate secured thereto; and a fourth tool for straightening frame rails of the body of the automobile, the fourth tool being comprised of an elongated rod having an upper end and a lower end, the lower end having a knob secured thereto, the upper end being tapered.

* * * * *